United States Patent [19]

Hayes et al.

[11] 4,430,023

[45] Feb. 7, 1984

[54] ROPE GUIDING DEVICE

[75] Inventors: Donald A. Hayes; Lyle D. Finn; Carl R. Brinkmann, all of Houston, Tex.

[73] Assignee: Exxon Production Research Co., Houston, Tex.

[21] Appl. No.: 335,474

[22] PCT Filed: Aug. 21, 1980

[86] PCT No.: PCT/US80/01069

§ 371 Date: Dec. 17, 1981

§ 102(e) Date: Dec. 17, 1981

[87] PCT Pub. No.: WO82/00675

PCT Pub. Date: Mar. 4, 1982

[51] Int. Cl.[3] ..... E02D 21/00; B63B 21/24

[52] U.S. Cl. ..... 405/224; 254/389; 405/195; 405/202; 114/293

[58] Field of Search ..... 405/195, 224, 202–208; 254/389–393, 416, 417, 901; 242/157 R; 226/196, 199; 114/264, 265

[56] References Cited

U.S. PATENT DOCUMENTS

| | | | |
|---|---|---|---|
| 2,529,486 | 11/1950 | Clarkson et al. | 242/157 R X |
| 2,986,889 | 6/1961 | Ludwig | 405/224 |
| 3,048,369 | 8/1962 | Hanson | 242/157 R X |
| 3,111,926 | 11/1963 | Shatto | 114/293 |
| 3,215,405 | 11/1965 | Walsh | 254/389 |
| 3,514,048 | 5/1970 | Lowery | 242/157 |
| 3,552,343 | 1/1971 | Scott | 114/293 |
| 3,834,600 | 9/1974 | Benchemoul | 242/157 X |
| 3,903,705 | 9/1975 | Beck et al. | 114/293 X |
| 3,934,528 | 1/1976 | Horton et al. | 405/224 X |
| 4,020,779 | 3/1977 | Kitt | 114/293 |
| 4,037,424 | 7/1977 | Anders | 405/224 X |
| 4,108,102 | 8/1978 | Lindstrom | 114/264 |
| 4,170,186 | 10/1979 | Shaw | 114/264 |

FOREIGN PATENT DOCUMENTS

| | | | |
|---|---|---|---|
| 689872 | 6/1964 | Canada | 405/224 |
| 187980 | 3/1967 | U.S.S.R. | 254/389 |

*Primary Examiner*—Dennis L. Taylor

*Attorney, Agent, or Firm*—John S. Schneider

[57] ABSTRACT

An adjustable two-piece rope guiding device [21, 26], particularly adaptable for use on offshore guyed tower drilling and production structures [11]. On such structures it is necessary to deflect a taut guy rope [14] into a direction that may not be precisely known, or that may vary with time. Such deflection must not damage the rope by excessive static or cyclic straining or by wearing. To minimize problems of clearance within the structure the guiding is performed in two parts: (1) a permanent deflection into a direction that satisfies the foregoing clearance requirements and (2) a variable deflection occurring beyond clearance problems that completes the required total deflection. When guiding the guy ropes [14] of an offshore oil production tower [11] from their vertical orientation at the clamping and jacking (tensioning) devices [20] on the tower to a seafloor anchoring system [15, 16] a first bending member [21] changes the vertical direction of the guy ropes [14] to a selected direction (plane) extending toward such anchoring system [15, 16]. A second bending member [26] rotates the rope in a new direction at the periphery of the offshore structure [11] to accommodate positions of the anchoring system [15, 16] with respect to the plane of the selected direction. The first member is a fixed shoe [21] having a grooved rope contacting surface [23] and a sleeve [24]. The second member [26] includes an outer fixed housing [45] and an inner rotatable housing [46] having a grooved surface [48] for contacting the rope.

6 Claims, 23 Drawing Figures

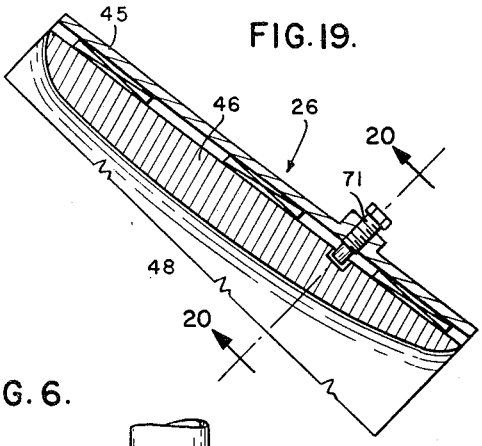
FIG. 19.
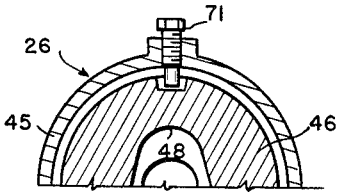
FIG. 20.
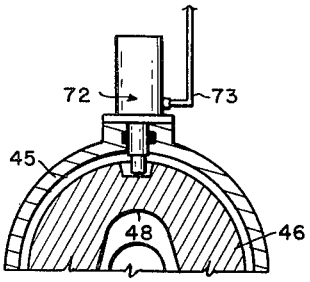
FIG. 21.
FIG. 6.
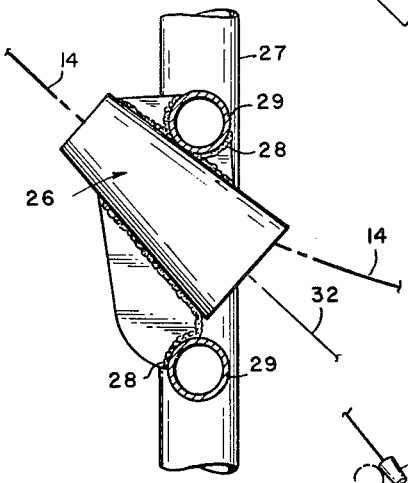
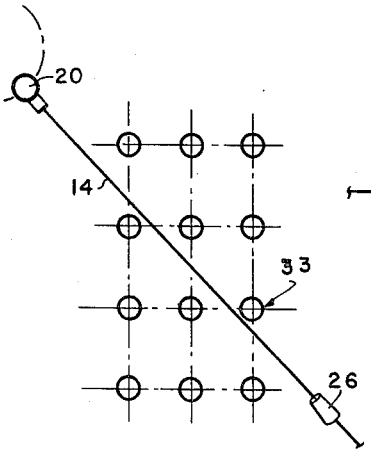
FIG. 7.
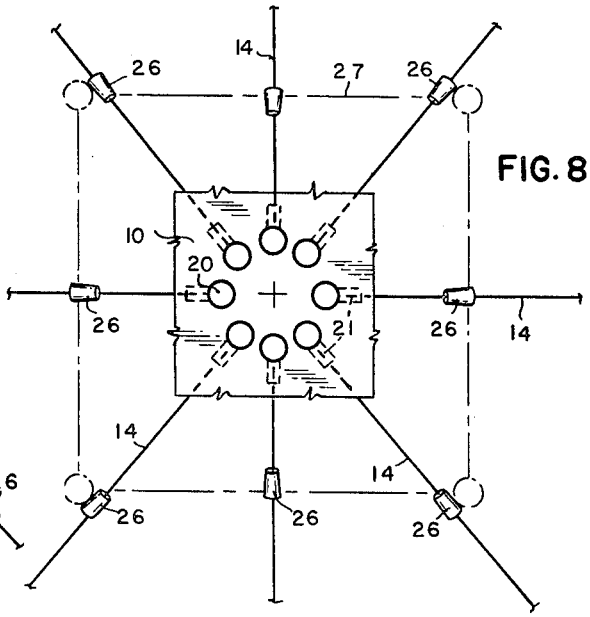
FIG. 8.

FIG. 18.
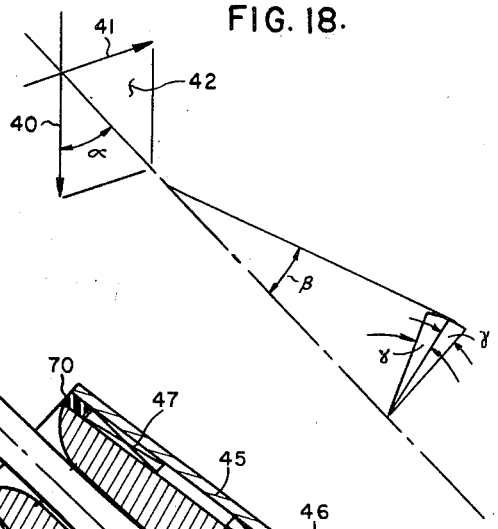
FIG. 10.
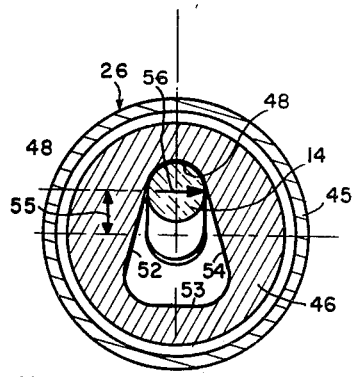
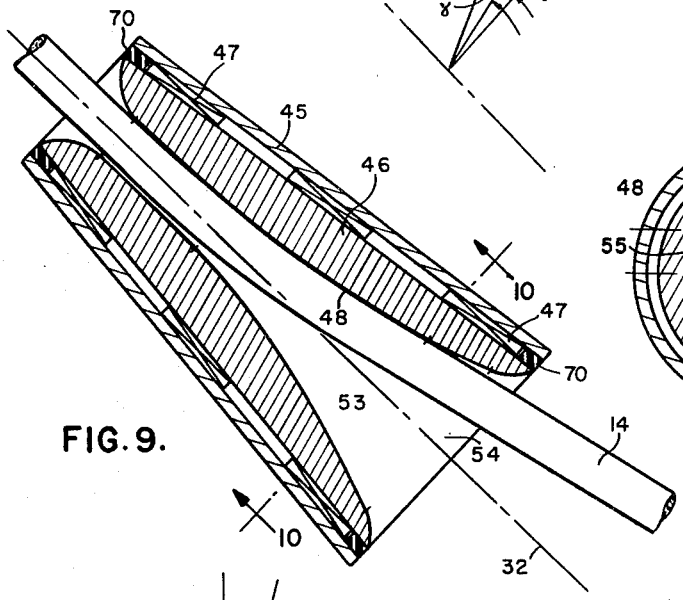
FIG. 9.
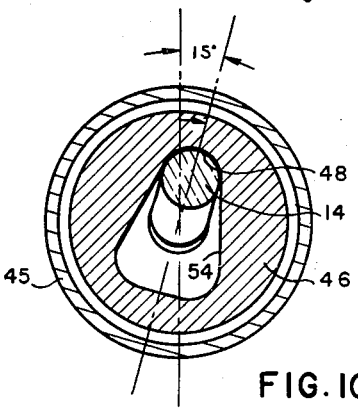
FIG. 10A.
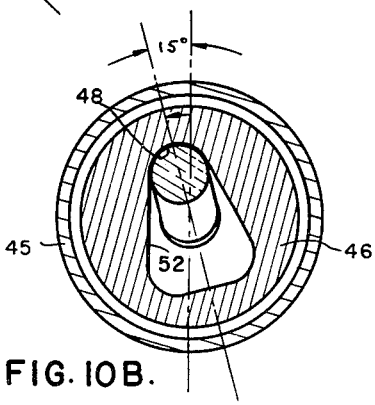
FIG. 10B.

ROPE GUIDING DEVICE

TECHNICAL FIELD

The present invention concerns rope guiding devices and, in particular, rope guiding devices which are applicable for guiding ropes used to anchor marine drilling and production structures.

BACKGROUND ART

There are several offshore platform concepts that have been proposed for use as drilling and producing platforms in deep water. Some of those platform concepts are designed to permit that platform to move in response to wave forces. One such design is the guyed tower. In the guying system for a guyed tower, guylines or ropes are run from the platform to anchor systems on the ocean floor. The guy ropes are secured at the platform deck by cable grips in a rope tensioning device and pass around deflecting devices or fairleads located below the water surface. The guy ropes then travel outwardly at an angle from the vertical to the anchoring system.

In the past both sheave and shoe type rope-deflecting devices have been proposed for use at the tower-guy rope juncture. Each type, however, must accommodate for misalignments of the tower and the anchor piles in order to minimize wear and fatigue of the guyed ropes. Swivel type deflecting devices have been suggested for this purpose. In the case where tensioning devices are located within the interior of the tower structure a deflecting device should be positioned within the interior of the tower directly below the tensioning device. The use of a swivel type deflecting device would result in interferences between the rope and internal structural elements. The problem then is to deflect a taut rope from the interior of the tower into the direction of the anchoring systems without interference from structural elements of the tower. The direction of the anchoring systems to the deflecting device may not be known exactly and, further, may vary with time as the tower may rotate. Such deflecting must not damage the rope by excessive static or cyclic straining or by wearing and clearance requirements within the tower itself must be met.

DISCLOSURE OF INVENTION

The foregoing problems are overcome by performing the rope deflection in two parts: (1) a fixed deflection into a direction that satisfies clearance requirements within the tower, and (2) a variable deflection occuring at the periphery of the tower to complete the required total deflection. Such problems are encountered in guiding the ropes of a guyed offshore oil drilling and production tower from their vertical orientation at the clamping and jacking (tensioning) devices atop the tower to seafloor anchor fixtures which encircle the tower at a great distance. The direction of the guylines is not known exactly because of unavoidable tower misalignment at installation and misplacement of the seafloor fixtures. Further tower movement which may occur during storms may vary the direction of the guy ropes by several degrees. Finally, congestion within the tower of structure, wells, and appertenances necessitates guiding the guy ropes through these structural elements from a first interior deflection to a second deflection at the perimeter of the tower structure.

The devices of the present invention solve this problem in the following manner. A first member fixed in position within the tower bends the rope in a first plane to a predetermined degree. A second member, also fixed in position on the periphery of the tower, bends the rope in the first plane, if necessary, and, also, deflects the rope in a direction out of the first plane. The fixed relative positions of the first and second members maintains a position of the rope which avoids any obstacles within the tower and the second member completes deflection of the rope beyond the tower.

The first member is a shoe having a grooved, curved rope-contact surface and a sleeve. The second member includes an outer fixed housing and an inner rotatable housing. The inner housing contains the rope and is provided with a grooved rope-contact surface and other contact surfaces to accommodate for all rope directions and forces expected. Bearing means between the housings permit the inner housing to rotate, thus, increasing the size and variety of potential rope deflections. The inner surface of the inner housing may have a triangular pyramidal configuration having rounded corners in which one of the corners of the pyramid forms the groove contact surface for the rope.

BRIEF DESCRIPTION OF DRAWINGS

FIG. 6 is a schematic, longitudinal view illustrating one part of the rope guiding device of the invention secured to a peripheral structural member of the guyed tower;

FIG. 7 is a diagrammatic top view of the rope guiding device of the invention in operational position within the guyed tower;

FIG. 8 is a diagrammatic top view illustrating the use of several radially extending rope guiding devices on the guyed tower;

FIG. 9 is a cross-sectional view of another part of the rope guiding device showing a rope extending therethrough;

FIG. 10 is a view taken along lines 10—10 of FIG. 9;

FIGS. 10A and 10B are similar to the view illustrated in FIG. 10 but showing, respectively, opposing angular deflections of the rope;

FIG. 18 is a diagramatic illustration of the manner in which the rope guiding device operates;

FIG. 19 is a partial cross-sectional view of the other part of the rope guiding device illustrating one manner of initially pinning the fixed housing to the rotatable housing of that part;

FIG. 20 is a view taken along lines 20—20 of FIG. 19; and

FIG. 21 is a view similar to that shown in FIG. 20 illustrating an alternative means for pinning the fixed and rotatable housings of the other part together.

BEST MODE FOR CARRYING OUT THE INVENTION

Figure 2:
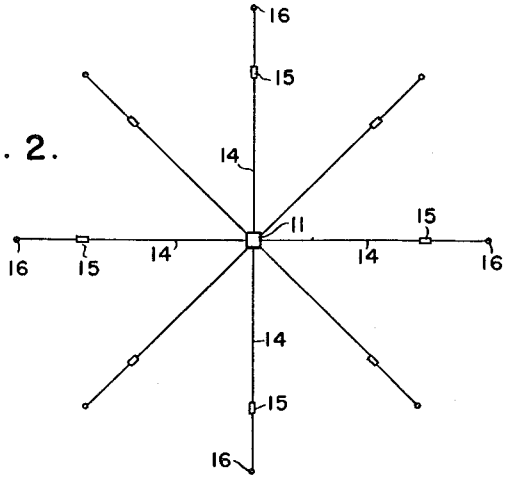
FIG. 2 is a top view of the marine structure shown in FIG. 1.
Figure 1:
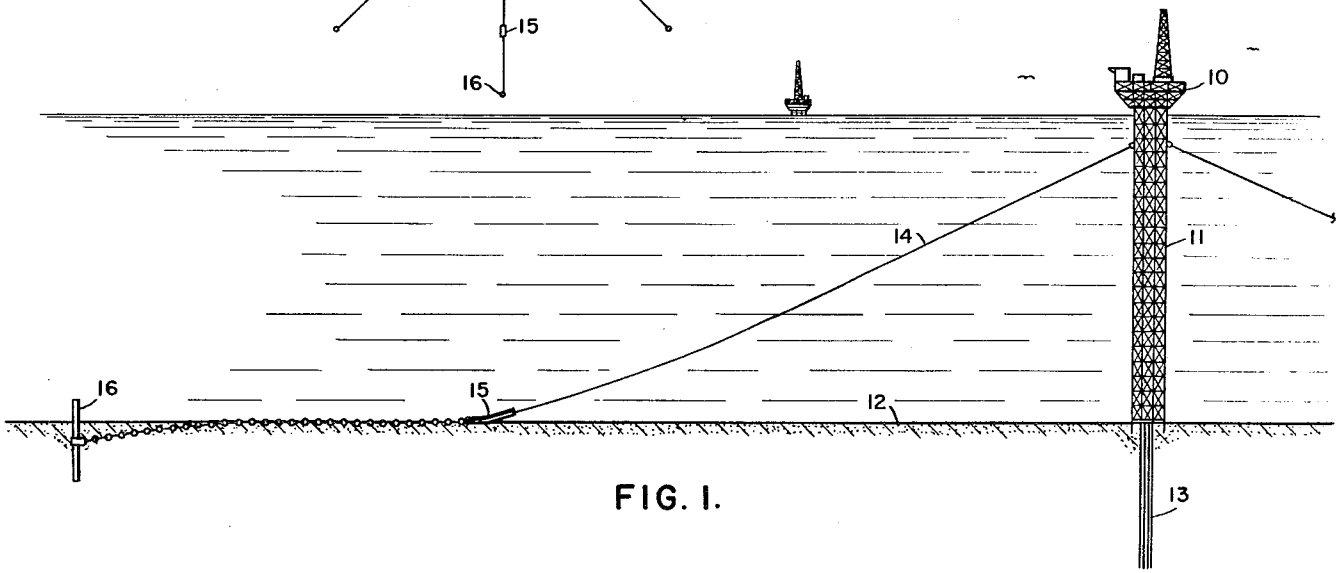
FIG. 1 is a schematic, longitudinal view of a guyed tower marine drilling and production structure.

FIGS. 1 and 2 illustrate an offshore drilling and producing platform 10 supported on a guyed tower 11 founded in the ocean floor 12 by piles (or a spud can or other type of foundation) indicated at 13. A series of guylines or ropes 14 radiate outwardly from tower 11. Each rope 14 is secured to the upper part of tower 11 at one end and to a suitable clump weight 15 and pile anchor or heavy drag anchor 16 on the ocean floor at the other end. A more detailed description of the operation and functioning of marine structures of this type may be found in U.S. Pat. No. 3,903,705 entitled "Apparatus for Anchoring Marine Structures" by R. W. Beck et al.

Tower 11 is constructed of a network of tubular structural members, as indicated. Also, production pipes extend upwardly through the interior of the tower and, in addition, many other appertenances for support of those pipes and other required drilling and production equipment are located within the confines of the tower.

Figures 3, 4, 5:
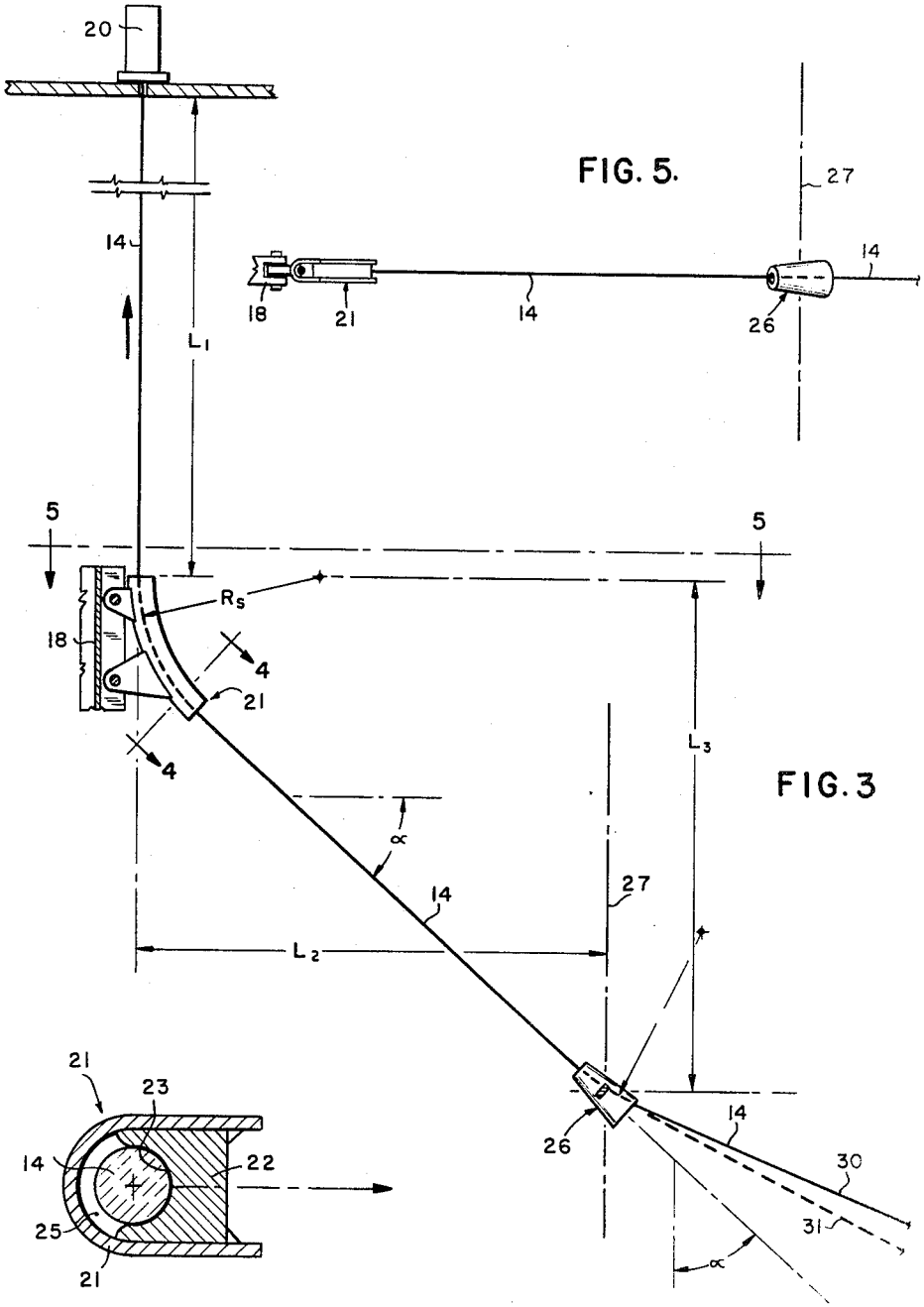
FIG. 3 is a schematic, longitudinal view illustrating the device of the invention in operational position on a guyed tower.
FIG. 4 is a view taken along lines 4—4 of FIG. 3.
FIG. 5 is a view taken along lines 5—5 of FIG. 3.
Figure 11:
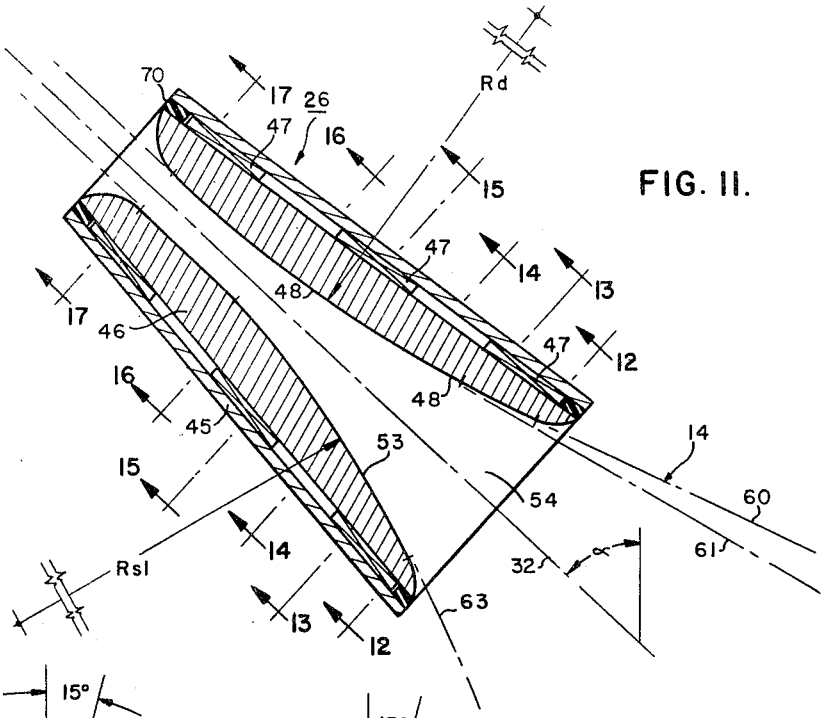
FIG. 11 is another cross-sectional view of the other part of the rope guiding device illustrating, along with FIGS. 12–17, more the design features of that part.
Figure 12:
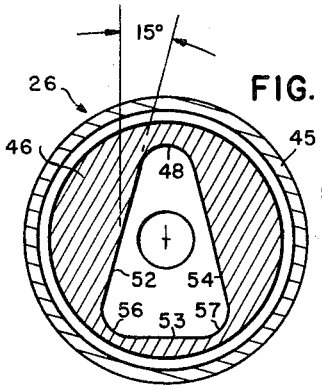
FIG. 12 is a view taken along lines 12—12 of FIG. 11.
Figure 13:
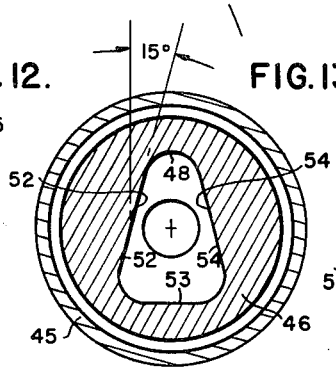
FIG. 13 is a view taken along lines 13—13 of FIG. 11.
Figure 14:
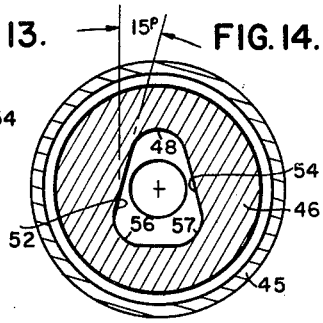
FIG. 14 is a view taken along lines 14—14 of FIG. 11.

Referring now to FIG. 3, there is illustrated a rope clamping and jacking (tensioning) device 20 supported on an interior portion of platform 10. A deflecting or bending member or shoe 21 is suitably secured to tower 11, as indicated at 18, vertically below tensioning device 20, as shown. As seen in FIG. 4, shoe 21 includes a retainer member 22 containing a grooved, curved rope-contact surface 23 and a surrounding U-shaped sleeve 24. Sleeve 24 holds rope 14 in place preparatory to tensioning, may contain anti-corrosion and/or lubricating material, as indicated at 25, and, as noted above, provides for attachment of shoe 21 to the tower.

A deflecting or bending member 26 is fixed in a position located below shoe 21 on the periphery of tower 11 which is indicated by line 27. It is secured, as indicated at 28 in FIG. 6, to peripheral support members 29 of tower 11. As seen also in FIG. 5, rope 14 extends in a straight line between the aligned lower end of fixed shoe 21 and the upper end of fixed member 26. Rope 14 is bent by member 26, as indicated at 30 and 31. It is also deflectable out of the plane of the bend of member 21.

The distance $L_1$ between platform 10 and the uppper end of shoe 21, the horizontal distance $L_2$ between shoe 21 and member 26, the vertical distance $L_3$ between shoe 21 and member 26, the radius of curvature $R_s$ of the shoe and the radius of curvature $R_d$ of deflecting member 26 will vary in accordance with any particular application. Line 32 designates the center line of member 26 which is also the center line of shoe 21.

The significance of the straight line design is apparent in the diagram of FIG. 7 where there are shown a plurality of production well (conductor) pipes 33 extending vertically within tower 11. Rope 14 must pass between those pipes, and avoid other appertenances within the tower. The relationship of rope 14 with respect to the interior clamping and jacking device 20, shoe 21 and member 26 are shown in this Figure.

FIG. 8 illustrates a complete arrangement of the several radially extending ropes 14, clamping and jacking devices 20, shoes 21 and members 26.

Deflecting member 26 is illustrated in more detail in FIGS. 9, 10, 10A and 10B. It includes an outer (cone) housing 45, and inner (cone) housing 46, and bearings 47 between those housings. Outer housing 45 attaches to the supporting structure as illustrated in FIG. 6. Inner housing 46 contains rope 14, which is shown positioned in a groove 48, and furnishes contact surfaces suitable for all rope directions and forces expected. Bearings 47 transfer forces between housings 45 and 46 while permitting inner housing 46 to rotate, thereby increasing the size and variety of potential rope deflections. As long as inner housing 46 is free to rotate within outer housing 45, any attempt by rope 14 to leave the plane of groove 48 will produce a correcting rotation, indicated by angle gamma ($\gamma$), about the axis of housing 46, as illustrated in FIGS. 10A and 10B.

Figure 15:
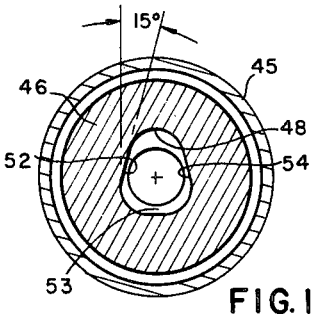
FIG. 15 is a view taken along lines 15—15 of FIG. 11.
Figure 16:
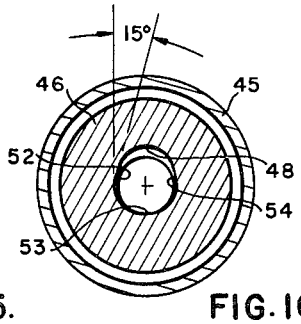
FIG. 16 is a view taken along lines 16—16 of FIG. 11.
Figure 17:
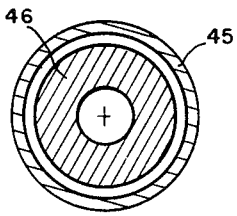
FIG. 17 is a view taken along lines 17—17 of FIG. 11.

The moment arm is indicated by the arrowed line 55 in FIG. 10. Arrowed line 56 indicates a force which causes rotation of housing 46 to the right as shown in FIG. 10A. The configuration of the interior surfaces of housing 46 is also illustrated in FIGS. 11 through 17. The straight side surfaces 52 and 54 and curved surface 53 and rounded corners 48, 56 and 57 form a three-sided pyramidal configuration. While FIG. 17 shows the smallest end of the opening through housing 46 as being circular in shape it may be shaped as the opening is shown in FIG. 16 or FIG. 15. That end, in any event, is preferably larger than the size of rope 14 as shown in FIGS. 9 and 10.

Lines 60 and 61 illustrate lines of departure of a taut rope 14 from groove surface 48 resulting from two different tensions applied to rope 14. Line 63 indicates rope 14 in slack position.

Seal rings 70 may be provided between the housings at each end thereof to seal in the bearings. The exterior surface of housing 46 and the interior surface of housing 45 may themselves comprise bearing surfaces which would make separate bearings unnecessary.

The ability of the two-part rope guiding device to deflect the rope 14 is illustrated in FIG. 18. Arrowed line 40 indicates the original rope direction, arrowed line 41 illustrates the orthogonal direction, and numeral 42 designates the vertical plane of the shoe 21. The angles alpha ($\alpha$), beta ($\beta$) and gamma ($\gamma$) refer to the bend of shoe 21, the bend of housing 46 in the plane of the shoe and rotation of housing 46 about its axis, respectively.

Referring now to FIGS. 19 and 20, it may be desirable to releasably pin outer housing 45 to inner housing 46 so that groove 48 of the inner housing will be in proper alignment with the axis of shoe 21. For that purpose, a bolt 71 threadable into housing 46 may be used to pin the two together. A diver could release bolt 71 when the device is to be put into operation. Alternatively, a remotely operated pinning device, such as the piston-cylinder arrangement 72 controllable by a hydraulic line 73, may be used instead. Alternatively, a shear pin could be used.

One manner of installing the device is to install shoes 21 and housing members 26 on the tower structure. The ends of ropes 14 are attached to the anchoring system 15, 16. Each rope 28 is then threaded through the housing member 26 and shoe 21 associated with it and connected at its upper end to cable grips connected into the tensioning device 20 on platform 10. If pinning means to pin outer housings 45 to inner housings 46 are used, the two housings are unpinned and ropes 14 made taut under catenary tension by tensioning devices 20. As the tension forces are applied when pulling in the ropes the moment arm will cause each inner housing 46 to rotate to compensate for any directional misalignment of the guyed members 21 and 26 with the anchor position. The inner housing may be rotated manually to any desired position before, during or after initially tensioning the rope.

Examples of some equipment sizes, angles and other dimensions which may be involved in an application of the rope guiding device described herein to guyed tower follows:

| | |
|---|---|
| Rope 14 - 5 inches | |
| Length of Member 26 - 5 feet | |
| Length of Shoe 21 - 15 feet | |
| Angle $\alpha$ - 48 degrees | Platform size - 100 feet square |
| | Platform height - 1000 feet |
| Angle $\beta$ - 15 degrees | Distance from tower to clump weight - 2000 feet |
| Distance $L_1$ - 35 feet | Distance from clump weight to pile anchor - 1000 feet |
| Distance $L_2$ - 85 feet | $R_s$ - 12 feet |
| Distance $L_3$ - 50 feet | $Radius_{s1}$ - 6 feet |
| Angle sides 52 and 54 from verticle - 15 degrees | |

The geometry of the surface opposite groove 48 will depend upon the particular application of the device. The configuration is chosen to support slack rope 14 preparatory to tensioning without damaging the rope. Consequently, while the preferred embodiment is illustrated with respect to guyed offshore drilling and production towers the principal of the invention is useful in other applications, marine or land. Although members 45 and 46 are shown conically shaped they may be formed cylindrically, rectangularly or in other shapes. The axis of rotation of housing 46 need not necessarily be through the center of the line of rope 14 extended between members 21 and 26. While the device is shown and described as a two-piece rope guiding device, in some applications only one piece, the bending or deflecting member 26, may be used to compensate for any misalignment between two members connected together by a rope.

Other changes and modifications may be made in the specific illustrative embodiments of the invention shown and/or described herein without departing from the scope of the invention as defined in the appended claims.

Having fully described the device, objects, advantages and operation of our invention, we claim:

1. Rope guiding apparatus for use in anchoring an offshore structure in which a rope extends from said structure to an anchoring system on the ocean floor comprising:

a rope guide member affixed to said structure and having inner and outer housings;

the inner surface of said inner housing forming a three-sided pyramidal configuration, one of the corners of the pyramid forming a curved rope-contacting groove extending in a first plane, said groove and said rope having substantially the same circumferential radius;

said inner housing being rotatable within said outer housing to rotate and change said first plane of said groove to a second plane of said groove to bend said rope from said first plane to said second plane to accommodate the position of the anchor system relative to said platform, the second plane being the plane of the portion of said rope extending between said rope guide member and said anchor system.

2. Rope guide apparatus as recited in claim 1 including rope tensioning means arranged on said platform connected to said rope; and another rope guide member affixed to said platform vertically below said rope tensioning means and capable of bending said rope to extend said rope in said first plane between said rope guiding members.

3. Rope guide apparatus as recited in claim 2 in which said other rope guiding member comprises a shoe having a grooved, curved rope-contacting surface and a curved sleeve surrounding said rope-contacting surface.

4. Rope guide apparatus as recited in claim 3 in which said one rope guiding member is fixed to the periphery of said offshore structure below said other rope guiding member, and said curved groove being formed in the upper corner of said pyramid and capable of bending said rope upwardly from said first to said second plane of said groove.

5. Rope guide apparatus as recited in claim 4 in which said rope guiding members are conically shaped and including bearings arranged between said inner and outer housings to permit said inner housing to rotate within said outer housing.

6. Rope guide apparatus as recited in claim 5 including means for releasably securing said inner and outer housings together to prevent rotation of said inner housing.

* * * * *